US009679545B1

(12) United States Patent
Chen

(10) Patent No.: US 9,679,545 B1
(45) Date of Patent: Jun. 13, 2017

(54) DRUM HOOP FASTENING DEVICE AND DRUM HAVING THE SAME

(71) Applicant: Kuo-Chang Chen, Taichung (TW)

(72) Inventor: Kuo-Chang Chen, Taichung (TW)

( * ) Notice: Subject to any disclaimer, the term of this patent is extended or adjusted under 35 U.S.C. 154(b) by 0 days.

(21) Appl. No.: 15/270,386

(22) Filed: Sep. 20, 2016

(51) Int. Cl.
*G10D 13/02* (2006.01)

(52) U.S. Cl.
CPC ..... *G10D 13/023* (2013.01)

(58) Field of Classification Search
CPC ..... G10D 13/023
See application file for complete search history.

(56) References Cited

U.S. PATENT DOCUMENTS 4,709,613 A * 12/1987 Powers ..... G10D 13/023 84/411 A
6,747,199 B2 * 6/2004 Shah ..... G10D 13/023 84/411 A
7,291,777 B2 * 11/2007 Chen ..... G10D 13/023 84/421
7,825,318 B2 * 11/2010 Ito ..... G10D 13/023 84/411 R
9,437,176 B2 * 9/2016 Simons ..... G10D 13/023
9,495,944 B1 * 11/2016 Chen ..... G10D 13/023
2003/0230185 A1 * 12/2003 Ishimatsu ..... G10D 13/023 84/411 R
2008/0173157 A1 * 7/2008 Liao ..... G10D 13/023 84/421
2014/0174278 A1 * 6/2014 Yu ..... G10D 13/025 84/413

* cited by examiner

*Primary Examiner* — Robert W Horn
(74) *Attorney, Agent, or Firm* — Muncy, Geissler, Olds & Lowe, P.C.

(57) ABSTRACT

A drum hoop fastening device and a drum having the same are provided. The drum hoop fastening device is disposed on a drum. A drum shell has a connecting portion, and a drum hoop has a first through hole along an axial direction. The drum hoop fastening device includes a bearing member which is positioned within the first through hole has a second through hole along the axial direction and a fastening member which is disposed through the second through hole and screwed with the connecting portion; and one of a wall of the second through hole and the fastening member has a first engaging portion extending radially, and the other of a wall of the second through hole and the fastening member radially interferes with the first engaging portion.

11 Claims, 5 Drawing Sheets

DRUM HOOP FASTENING DEVICE AND DRUM HAVING THE SAME

BACKGROUND OF THE INVENTION

Field of the Invention

The present invention relates to a drum hoop fastening device and a drum having the same.

Description of the Prior Art

Conventionally, a drum has a drum shell which is hollow, a drumhead covering two opening ends of the drum shell and a drum hoop covering the drumhead and the drum shell, and an exterior periphery of the drum shell has a plurality of connecting portions. A user can adjust a tightness of the drumhead through adjusting a position of the drum hoop covering the drum shell. A plurality of bolts are respectively disposed through a plurality of through holes of the drum hoop and screwed with the connecting portions, the user can screw and move relative positions of the bolts and the connecting portions to change the position of the drum hoop and further to adjust the tightness of the drumhead so as to adjust a sound and a tune produced when the drumhead is hit.

However, the drum vibrates when being hit, the drum hoop of the drum contacts the bolts; therefore, when the drum vibrates, the drum hoop transmits a seismic wave produced to the bolts so that the bolts loosen and shake easily. After the bolts loosen, the drumhead get loose, and the sound and the tune of the drum change, so the bolts of the conventional drum need to be repeatedly adjusted.

The present invention has arisen to mitigate and/or obviate the afore-described disadvantages.

SUMMARY OF THE INVENTION

The major object of the present invention is to provide a drum hoop fastening device and a drum having the same which can effectively prevent the drum hoop fastening device from loosening due to the vibration produced when the drum is hit.

To achieve the above and other objects, a drum hoop fastening device is provided. The drum hoop fastening device is for being disposed on a drum, the drum includes a drum shell, a drumhead arranged on the drum shell and a drum hoop covering an opening end of the drum shell and the drumhead, an exterior circumferential wall of the drum shell has a connecting portion, and the drum hoop has a first through hole along an axial direction. The drum hoop fastening device includes a bearing member and a fastening member; the bearing member is positioned within the first through hole, and the bearing member has a second through hole along the axial direction; the fastening member is disposed through the second through hole of the bearing member and screwed with the connecting portion for fixing the drum hoop to the drum shell; and one of a wall of the second through hole and an exterior circumferential wall of the fastening member has a first engaging portion extending radially, and the other of the wall of the second through hole and the exterior circumferential wall of the fastening member radially interferes with the first engaging portion.

To achieve the above and other objects, a drum is further provided, including a plurality of the drum hoop fastening devices mentioned above, the drum further includes a drum shell, at least one drumhead and at least one drum hoop; an exterior circumferential wall of the drum shell has a plurality of connecting portions; the at least one drumhead is arranged on the drum shell; the at least one drum hoop covers the opening end of the drum shell and the drumhead, and each said drum hoop has a first through hole along the axial direction.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
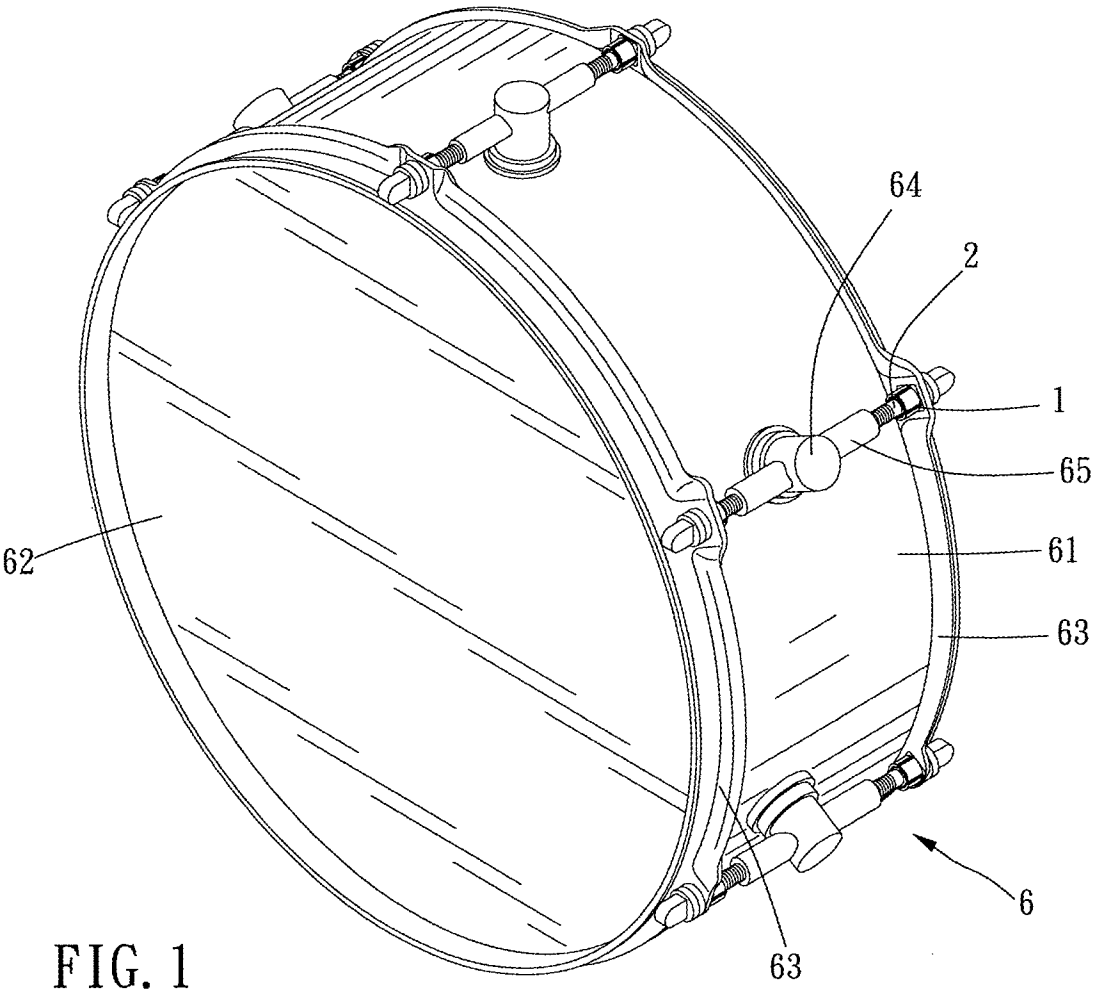
FIG. 1 is a stereogram of a preferred embodiment of the present invention.
Figures 2, 3:
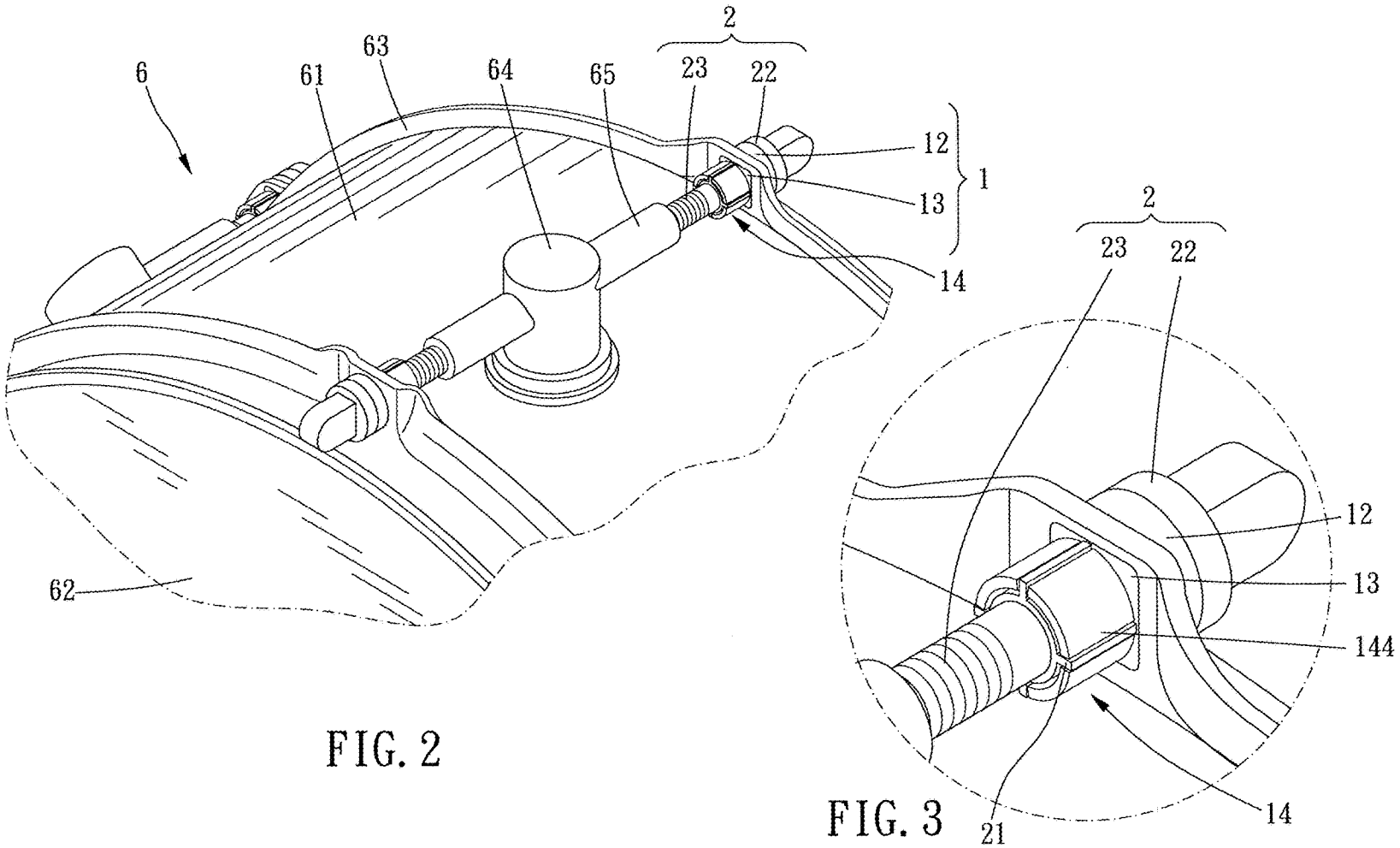
FIG. 2 is a partial view of the preferred embodiment of the present invention.
FIG. 3 is a partially-enlarged view of FIG. 2.
Figure 4:
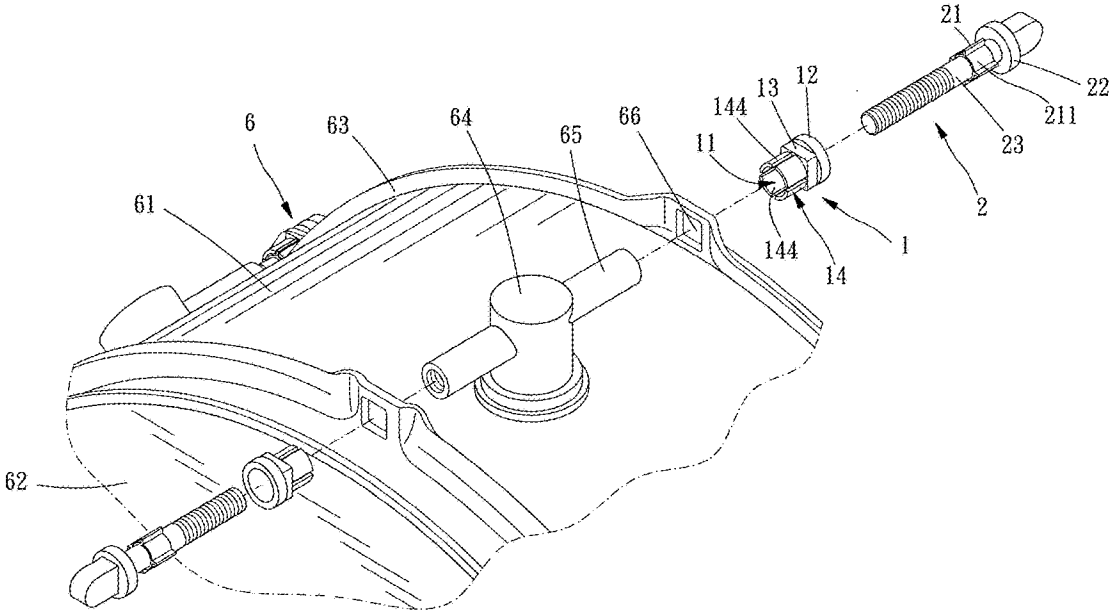
FIG. 4 is a breakdown view of the preferred embodiment of the present invention.
Figure 5:
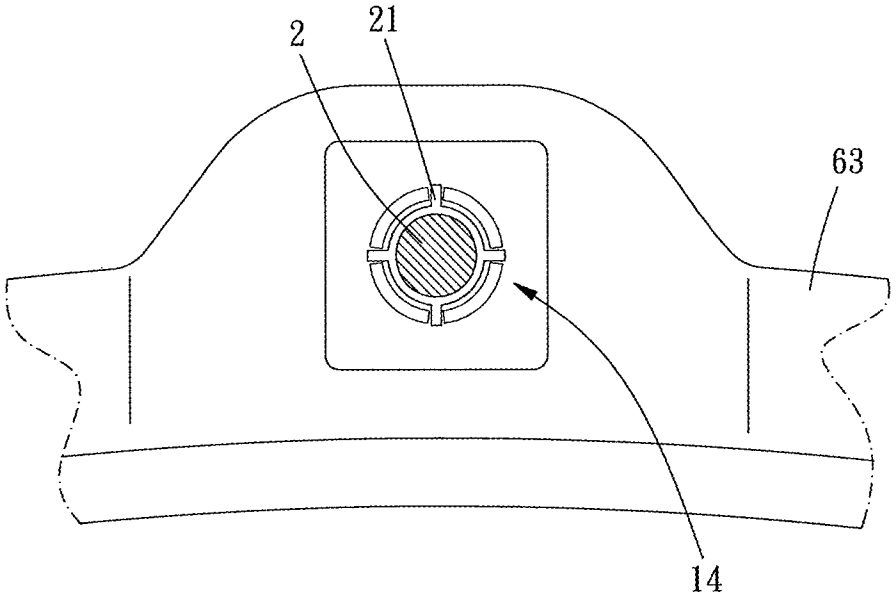
FIG. 5 is a partially cross-sectional view of the preferred embodiment of the present invention.
Figure 6:
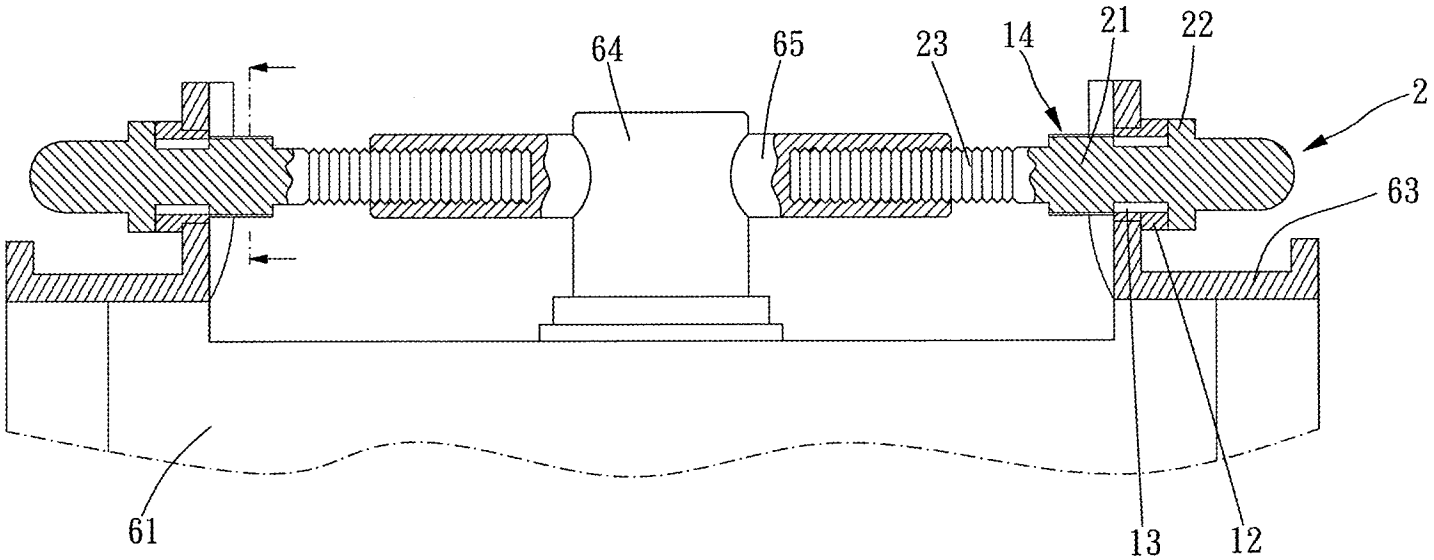
FIG. 6 is another partially cross-sectional view of the preferred embodiment of the present invention.

FIGS. 1 to 6 show a preferred embodiment of the present invention. A drum hoop fastening device is for being disposed on a drum 6, the drum 6 includes a drum shell 61, a drumhead 62 arranged on the drum shell 61 and a drum hoop 63 covering an opening end of the drum shell 61 and the drumhead 62, an exterior circumferential wall of the drum shell 61 has a connecting portion 64, the drum hoop 63 has a first through hole 66 along an axial direction, and the drum hoop fastening device includes a bearing member 1 and a fastening member 2.

The bearing member 1 is positioned within the first through hole 66, the bearing member 1 has a second through hole 11 along the axial direction, and a wall of the second through hole 11 has a first engaging portion 14.

The fastening member 2 is disposed through the second through hole 11 of the bearing member 1 and screwed with the connecting portion 64 for fixing the drum hoop 63 to the drum shell 61, an exterior circumferential wall of the fastening member 2 has a second engaging portion 21 extending radially, and when the fastening member 2 rotates, the first engaging portion 14 radially interferes with the second engaging portion 21 so as to prevent the fastening member 2 from rotating randomly relative to the bearing member 1. When the drum 6 is hit and vibrates, the first engaging portion 14 radially interferes with the second engaging portion 21 to effectively prevent the fastening member 2 from rotating and from loosening from the connecting member 64. Therefore, a user does not need to adjust the fastening member 2 frequently, and when the fastening member 2 rotates relative to the bearing member 1, the user can apply a greater force to make the first engaging portion 14 or the second engaging portion 21 to flexibly deform so that the fastening member 2 can rotate relative to the bearing member 1. It is understandable that in other embodiments, there may be no second engaging portion, the first engaging portion may radially interfere with the exterior circumferential wall of the fastening member, or the first engaging portion may be arranged on the exterior circumferential wall of the fastening member.

Specifically, the bearing member 1 includes a radially-enlarged section 12 and a radially-reduced section 13, the second through hole 11 is disposed through the radially-enlarged section 12 and the radially-reduced section 13, and the radially-reduced section 13 is for being engaged within the first through hole 66. Preferably, the first through hole 66 is non-circular (in this embodiment, the first through hole is square), and the radially-reduced section 13 corresponds to the first through hole 66 in shape to prevent the bearing member 1 and the first through hole 66 from rotating relative to each other. In other embodiments, the first through hole 66 may be circular, the radially-reduced section 13 may be tight fit to engaged within the first through hole 66 to prevent the bearing member 1 and the first through hole 66 from rotating relative to each other. Furthermore, in other embodiments, the bearing member 1 and the first through hole 66 may be integrally formed, and the first engaging portion 14 radially interferes with the second engaging portion 21 to effectively prevent the fastening member 2 from rotating.

Specifically, the fastening member 2 includes a head portion 22 and a body portion 23, the head portion 22 is greater than the body portion 23 in diameter, the body portion 23 is disposed through the second through hole 11 and screwed with the connecting portion 64, the head portion 22 abuts against the radially-enlarged section 12 so that the radially-enlarged section 12 axially abuts against a hole edge of the first through hole 66, and the head portion 22 abuts against the radially-enlarged section 12 to decrease a seismic wave transmitted to the head portion 22 when the drum 6 vibrates. Preferably, the first engaging portion 14 and the bearing member 1 are integrally formed, and the second engaging portion 21 integrally extends from the body portion 23. In this embodiment, the second engaging portion 21 is disposed on an end of the body portion 23 near the head portion 22, and the second engaging portion 21 includes a plurality of rib portions 211 radially protruding. Specifically, in this embodiment, the bearing member 1 is made of plastic, the first engaging portion 14 extends from an end of the radially-reduced section 13 remote from the radially-enlarged section 12, the first engaging portion 14 has a plurality of petals 144 which are radially swingable, the fastening member 2 is a metal bolt, and when the user rotates the fastening member 2, the first engaging portion 14 deforms slightly so as to make each said second engaging portion 21 cross the petal 144 of the first engaging portion 14. It is to be noted that the first engaging portion 14 radially interferes with the second engaging portion 21, so when each said rib portion 211 radially interferes with one said petal 144, the fastening member 2 will not axially move relative to the bearing member 1 to make it more smooth for the user to screw the fastening member 2 to adjust the sound of the drum 6. It is understandable that in other embodiments, the first engaging portion may has an height-differentiated structure (for example, a rib portion), the height-differentiated structure is for radially interfering with the second engaging portion to effectively prevent the fastening member from rotating randomly and from the fastening member loosening from the connecting portion.

A drum 6 is further provided, the drum 6 includes the drum hoop fastening device mentioned above, and the drum 6 further includes the drum shell 61, at least one said drumhead 62 and at least one said drum hoop 63.

The exterior circumferential wall of the drum shell 61 has a plurality of connecting portions 64. The at least one drumhead 62 is arranged on the drum shell 61. The at least one drum hoop 63 covers the drumhead 62 and the opening end of the drum shell 61, and each said drum hoop 63 has the first through hole 66 along the axial direction. In this embodiment, the drum 6 includes two said drumheads 62 and two said drum hoops 63, and the two drum hoops 63 and the two drumheads 62 respectively arranged on two opening ends of the drum shell 61 opposite to each other.

Each said connecting portion 64 further has at least one connecting tube 65, each said connecting tube 65 extends toward one said drum hoop 63, and each said connecting tube 65 is screwed with one said fastening member 2. In this embodiment, each said connecting portion 64 includes two said connecting tubes 65, the two connecting tubes 65 are respectively screwed with one said fastening member 2, the first engaging portion 14 of each said bearing member 1 radially interferes with the second engaging portion 21 of one said fastening member 2 so as to prevent the fastening members 2 from loosening when the drum 6 is hit and vibrates.

Given the above, in the drum hoop fastening device and the drum having the same, the first engaging portion radially interferes with the second engaging portion so as to effectively prevent the fastening member from rotating randomly and from loosening from the connecting portion.

In addition, the first engaging portion radially interferes with the second engaging portion, so when each said second engaging portion radially interferes with one said engaging portion, the fastening member will not axially move relative to the bearing member to make it smoother for the user to screw the fastening member to adjust the sound of the drum.

While we have shown and described various embodiments in accordance with the present invention, it should be clear to those skilled in the art that further embodiments may be made without departing from the scope of the present invention.

What is claimed is:

1. A drum hoop fastening device, for being disposed on a drum, the drum including a drum shell, a drumhead arranged on the drum shell and a drum hoop covering an opening end of the drum shell and the drumhead, an exterior circumferential wall of the drum shell having a connecting portion, the drum hoop having a first through hole along an axial direction, the drum hoop fastening device including:

a bearing member, positioned within the first through hole, the bearing member having a second through hole along the axial direction;

a fastening member, disposed through the second through hole of the bearing member and screwed with the connecting portion for fixing the drum hoop to the drum shell;

wherein one of a wall of the second through hole and an exterior circumferential wall of the fastening member has a first engaging portion extending radially, and the other of the wall of the second through hole and the exterior circumferential wall of the fastening member radially interferes with the first engaging portion.

2. The drum hoop fastening device of claim 1, wherein the wall of the second through hole has the first engaging portion, the exterior circumferential wall of the fastening member has a second engaging portion extending radially, and the first engaging portion radially interferes with the second engaging portion.

3. The drum hoop fastening device of claim 2, wherein the bearing member includes a radially-enlarged section and a radially-reduced section, the second through hole is disposed through the radially-enlarged section and the radially-reduced section, and the radially-reduced section is for being engaged within the first through hole.

4. The drum hoop fastening device of claim 3, wherein the fastening member includes a head portion and a body portion, the head portion is greater than the body portion in diameter, the body portion is disposed through the second through hole and screwed with the connecting portion, and the head portion abuts against the radially-enlarged section so that the radially-enlarged section axially abuts against a hole edge of the first through hole.

5. The drum hoop fastening device of claim 4, wherein the second engaging portion is disposed on an end of the body portion near the head portion, and the second engaging portion includes a plurality of rib portions protruding radially.

6. The drum hoop fastening device of claim 4, wherein the first engaging portion and the bearing member are integrally formed, and the second engaging portion integrally extends from the body portion.

7. The drum hoop fastening device of claim 4, wherein the first through hole is non-circular, and the radially-reduced section corresponds to the first through hole in shape.

8. The drum hoop fastening device of claim 4, wherein the first engaging portion extends from an end of the radially-reduced end remote from the radially-enlarged section, and the first engaging portion has a plurality of petals which are radially swingable.

9. The drum hoop fastening device of claim 4, wherein the second engaging portion is disposed on an end of the body portion near the head portion, the second engaging portion includes a plurality of rib portions radially protruding; the first engaging portion and the bearing member are integrally formed, the second engaging portion is integrally extends from the body portion; the first through hole is non-circular, the radially-reduced section corresponds to the first through hole in shape; the first engaging portion extends from an end of the radially-reduced end remote from the radially-enlarged section, and the first engaging portion has a plurality of petals which are radially swingable.

10. A drum, including the drum hoop fastening device of claim 1, further including:

a drum shell, an exterior circumferential wall of the drum shell having a plurality of connecting portions;

at least one drumhead, arranged on the drum shell;

at least one drum hoop, covering an opening end of the drum shell and the drumhead, each said drum hoop having a first through hole along an axial direction.

11. The drum of claim 10, wherein each said connecting portion further has at least one connecting tube, each said connecting tube extends toward the drum hoop, and each said connecting tube is screwed with one said fastening member.

* * * * *